United States Patent [19]

Wheeler

[11] Patent Number: 4,800,702

[45] **Date of Patent: * Jan. 31, 1989**

[54] STEEL PLACEMENT MEMBER

[76] Inventor: Charles F. Wheeler, 6141 NW. 34th Way, Ft. Lauderdale, Fla. 33309-2221

[ * ] Notice: The portion of the term of this patent subsequent to Feb. 24, 2004 has been disclaimed.

[21] Appl. No.: 17,500

[22] Filed: Feb. 24, 1987

Related U.S. Application Data

[63] Continuation-in-part of Ser. No. 835,292, Mar. 3, 1986, Pat. No. 4,644,726.

[51] Int. Cl.[4] ..... E04C 5/16

[52] U.S. Cl. ..... 52/677; 52/678; 52/704; 52/687; 249/217

[58] Field of Search ..... 52/677–689; 248/49, 65, 68.1, 156, 500, 507, 508, 413; 404/70, 64, 65, 66, 67, 68, 69, 136; 249/213–218, 219.1, 219.2

[56] References Cited

U.S. PATENT DOCUMENTS

| | | | |
|---|---|---|---|
| Re. 14,075 | 2/1916 | Noetzel et al. | 52/681 X |
| 1,123,107 | 12/1914 | Darr | 52/684 |
| 1,513,592 | 10/1924 | Johnson | 52/678 |
| 1,672,852 | 6/1928 | Roughan . | |
| 1,924,724 | 8/1933 | Olney . | |
| 2,194,834 | 3/1940 | Nealon . | |
| 2,627,176 | 2/1953 | Levy | 52/704 X |
| 3,114,221 | 12/1963 | Eriksson . | |
| 3,127,703 | 4/1964 | Eshelman | 52/678 |
| 3,277,556 | 10/1966 | Platt et al. | 52/677 X |
| 3,289,379 | 12/1966 | Watts | 52/678 X |
| 3,300,930 | 1/1967 | Weise . | |
| 3,333,380 | 8/1967 | Wolf | 52/678 X |
| 3,376,010 | 4/1968 | Myer | 52/677 X |
| 3,405,497 | 10/1968 | McNair | 52/704 X |
| 3,464,661 | 9/1969 | Alesi, Jr. . | |
| 3,579,938 | 5/1971 | Hanson | 52/678 X |
| 3,673,753 | 7/1972 | Anderson | 52/680 X |
| 4,040,222 | 8/1977 | Cull | 52/678 X |
| 4,060,954 | 12/1977 | Liuzza . | |
| 4,644,726 | 2/1987 | Wheeler | 52/677 |

OTHER PUBLICATIONS

Universal Concrete Specialties, product brochure, Jan 3, 1918.

*Primary Examiner*—David A. Scherbel
*Assistant Examiner*—Richard E. Chilcot, Jr.
*Attorney, Agent, or Firm*—Karen M. Gerken; Martin P. Hoffman; Mitchell B. Wasson

[57] ABSTRACT

A steel placement member adapted for supporting and locating a reinforcing steel bar in a concrete structural member formed by placing concrete in an area defined by a horizontal bottom surface and a vertical perimetrical surface. The steel placement member is defined by a tubular body having a channel formed in one end for receiving the end of a reinforcing bar. The opposite end of the tubular body is provided with a plate member lying perpendicular thereto and being adapted to abut the vertical perimetrical surface. According to a preferred embodiment of the invention, the plate member is provided with a vertically depending arrow member which is adapted to rest against the horizontal bottom surface. The steel placement member, with the plate member abutting the vertical surface and the arrow member resting against the bottom surface, supports the reinforcing bar within the channel and locates the reinforcing bar a desired distance inside the vertical surface and above the bottom surface.

17 Claims, 1 Drawing Sheet

STEEL PLACEMENT MEMBER

This application is a continuation-in-part of applicant's co-pending U.S. patent application Ser. No. 835,292, filed Mar. 3, 1986, and now U.S. Pat. No. 4,644,726.

BACKGROUND OF THE INVENTION

1. Field of the Invention

The present invention is directed to a steel placement member for the placement and support of reinforcing steel in concrete structural members and, in particular, in concrete foundations and slabs.

An essential aspect of reinforced concrete design involves the accurate placement and support of reinforcing steel bars in a concrete structural member. It is crucial that the reinforcing steel be precisely located and supported an adequate distance inside the face of the concrete. Failure to maintain the reinforcing steel a sufficient distance inward of the face of the concrete results in undesirable oxidation of the steel, necessitating very costly and extensive restoration of the structural member. The steel placement assembly of the present invention overcomes the problem of oxidation by accurately locating the steel reinforcement the optimum distance inside the concrete face.

The integrity of a concrete structural member is further determined by how effectively the reinforcing steel bars are maintained in position within the concrete form to prevent unwanted shifting of the steel when the concrete is placed. Despite the best efforts of construction personnel to place and hold reinforcing bars within the concrete form, the forces realized while placing the concrete inevitably shift the steel from its specified position or cause failure and deformation of the steel supporting devices.

As a result, Code-specified dimensions for concrete cover are negated, with future costly corrective and restorative work a probable consequence. The inability of present steel placement devices to accurately attain code specifications results, additionally, in approval delays which seriously undermine the budget and schedule allocated for a particular construction project. Even more critically, the deterioration arising from improperly located steel reinforcement is apt to cause dangerous structural damage which creates serious liabilities for the builder, engineer and architect.

The subject steel placement member prevents undesirable movement or shifting of the steel from design parameters and thereby enhances the ability of architects and engineers to design more efficiently. The attributes in design and placement of the reinforcing steel realized through utilization of the instant invention result in lower costs of construction and maintenance for reinforced structural members. The present steel placement member provides a fast, easy and inexpensive means for maintaining the integrity reinforcing steel, both during construction and for the life of the structural member.

More specifically, the present invention provides a steel placement member which positively supports and locates a reinforcing steel bar the required distance inside the face of the concrete and above the foundation pad. The subject steel placement member is uniquely capable of securing the steel reinforcing bars against lateral and rotational movement. The steel placement member is formed to accommodate reinforcing steel bars of diverse sizes, being color-coded according to steel size to allow for quick and easy identification in the field. Further, the steel placement member is integrally molded of styrene and/or polyethylene in a manner conducive to mass-production at relatively low cost. Capable of supporting a reinforcing steel bar firmly, the steel placement member is able to withstand the pressures imposed during placement of the concrete without damage or failure and is durable enough that construction personnel may walk upon the reinforcing mate to set dowels or bolts or perform other required procedures. Moreover, the steel placement member is light in weight, is easy to carry and transport, and is suitable for storage in bulk amounts until needed.

Finally, because a portion of the steel placement member remains visible after the forms are removed, it is possible to supervise and inspect its proper use during construction, immediately and even years later. The color-coding system allows builders, architects and engineers to verify that the correct size of reinforcing steel bar was utilized, thereby providing a built-in assurance of quality for the life of the reinforced concrete structural member.

2. Prior Art

Several prior art patents are directed to supports or chairs for concrete reinforcing members. For example, U.S. Pat. No. 4,060,954 discloses a bar chair comprising a body member having tubular depending legs which snap onto the upwardly extending outer stads provided on the upper surface of an identical body member. Inside studs on the upper surface of each body member cooperate with the outer studs to retain various sizes of reinforcing bars.

U.S. Pat. No. 2,194,834 discloses a reinforced concrete stool comprising an upper section which fits over a lower section that has formed therein a notch for receiving a reinforcing rod. Similarly, U.S. Pat. No. 1,672,852 shows a support for a concrete reinforcing member consisting of a flat base and an upright body having a bifurcation in its upper end and for supporting a reinforcing member in proper relation.

Components for the horizontal and vertical spacing of tubular members are also known in the prior art. U.S. Pat. No. 3,464,661 is directed to a conduit spacer apparatus comprising identical spacer members which mate to form a plurality of recesses for retaining tubular conduit. Each spacer is provided with upwardly projecting tongues and downwardly opening tongue receiving receptacles. The upwardly projecting tongues of one spacer member are inserted into the receptacles of the spacer member to which it mates.

None of the prior art patents discloses an apparatus which is capable of effectively positively locating and supporting reinforcing steel against both lateral and rotational movement and a desired distance within the face of the concrete, while withstanding the force and stress imposed during concrete placement. Furthermore, the prior art fails to provide a device which accurately locates the reinforcing steel to prevent undesired movement while the concrete is being placed and which is, simultaneously, field-adaptable. The present invention accomplishes the foregoing objectives while being adaptable to produce structural members of various sizes which are subject to diverse reinforcement specifications and requirements, and while being easy, cost-effective and convenient to use.

SUMMARY OF THE INVENTION

The present invention is directed to a steel placement member which is adapted to securely support and position a reinforcing steel bar in a concrete structural member and, in particular, in a reinforced concrete foundation or slab. The steel placement member is specifically adapted to locate a reinforcing steel bar the required distance in ide the face of the concrete in accordance with applicable technical specifications. Additionally, the steel placement member is adapted to secure a reinforcing steel bar against lateral and rotational movement during placement of the concrete.

The steel placement member comprises a tubular body having a circular channel formed in one end and being provided at the opposite end with a planar plate member lying in a plate perpendicular to the longitudinal axis of the tubular body. A plurality of outwardly tapering through holes are formed in the plate member for receiving nails, or other like fastening means, for securing the steel placement member to the interior surface of a wood form. When so secured to the form, the back surface of the plate member abuts the interior surface of the wood form.

The plate member is provided, directly beneath the tubular body, with a vertically depending arrow member having a tip which is adapted to abut the foundation pad when the steel placement member is secured to the form. Thus, the steel placement member may be easily utilized in the field simply by resting the tip of the arrow member against the foundation pad and locating the back surface of the plate member in abutting relationship to the interior surface of the wood form.

The steel placement member is adapted to hold an end of a reinforcing steel bar within the circular channel formed in the tubular body. The invention provides for forming the circular channel of diverse diameter so as to accommodate reinforcing steel bars of various sizes. Additionally, the depth of the circular channel is such that the channel terminates two inches, or for some applications three inches, inside the back surface of the plate member. Hence, the steel placement member holds the end of the reinforcing steel bar two or three inches, or any required distance, inside the face of the concrete.

The steel placement member holds the reinforcing steel bar three inches, or any required distance, above the foundation pad. This attribute is realized by forming the steel placement such that the distance from the channel to the tip of the arrow corresponds to the distance above the foundation pad that the steel reinforcing bar is required to be placed.

The steel placement members of the present invention is integrally molded of styrene and/or polyethylene for strength and durability. Additionally, the steel placement members are adapted to be color-coded according to the size of the reinforcing steel bars which they are to accept, thereby allowing for quick identification during construction and subsequent thereto.

DETAILED DESCRIPTION OF THE PREFERRED EMBODIMENT

Figure 1:
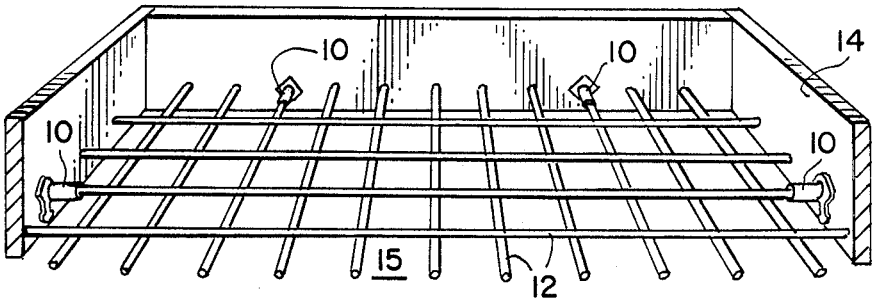
FIG. 1 is a partial perspective view of the concrete form for a foundation showing the steel placement members of the present invention prior to placement of the concrete.
Figure 2:
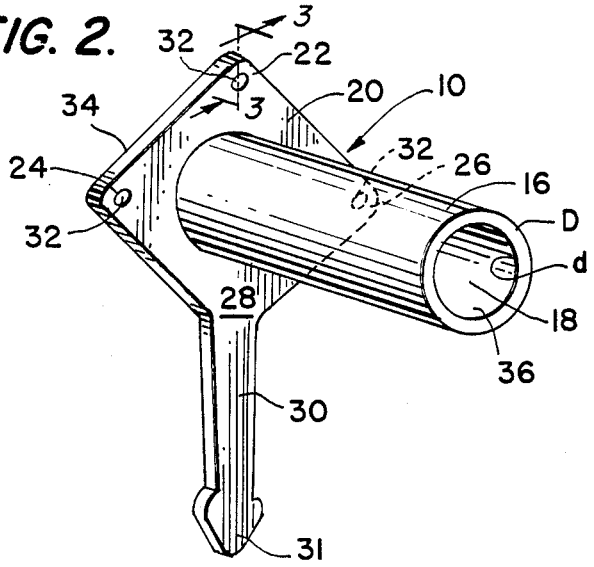
FIG. 2 is a perspective view of the steel placement member of the present invention.
Figure 3:
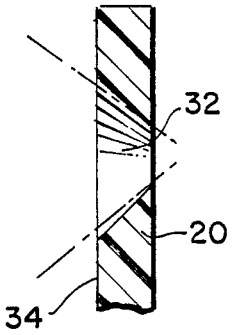
FIG. 3 is a partial side sectional view taken through line 3—3 of FIG. 2.

Referring to the drawings and, in particular, with reference to FIGS. 1–3, there is shown a steel placement member 10 which serves to support the end of a reinforcing steel bar 12 to locate the reinforcing steel bar within a concrete form 14 in accordance with the applicable technical specifications. FIG. 1 depicts a plurality of steel placement members 10 as they appear when secured to the interior surface of a perimetrical concrete form 14 for a foundation or slab reinforced concrete structural member and holding the ends of reinforcing steel bars 12 such that the reinforcing bars are disposed above the foundation pad 15.

As is best depicted in FIG. 2, each steel placement member 10 comprises a cylindrical tubular body 16 having formed in one end of a circular channel 18 for receiving an end of the reinforcing steel bar 12. The end of the tubular body opposite the channel 18 is provided with a plate member 20 which lies in a plane perpendicular to the longitudinal axis of the tubular body 16. The plate member 20 is of generally square configuration, being oriented in relation to the tubular body 16 in the manner illustrated in FIG. 2. As illustrated therein, the plate member 20 is structurally oriented such that, when the tubular body is viewed from the front, looking into the channel 18, a first corner 22 of the plate member 20 is disposed directly above the tubular body and second and third corners 24, 26, respectively, of the slate member are disposed directly opposite each other, one on each side of the tubular body. A fourth corner 28 of the plate member is disposed directly below the tubular body and merges with an integral vertically depending arrow member 30 having a tip 31.

It can be seen in FIG. 2 that the first corner 22, the second corner 24 and the third corner 26 are each rounded and provided with through hole 32. As is most clearly depicted in FIG. 3, each through hole 32 is formed in the plate member 20 so as to taper outwardly from the front of the plate member to the back thereof. Each through hole is adapted to receive a nail (not shown), or like securing means, for purposes of securing the steel placement member to the interior surface of the concrete form 14. The outwardly tapering configuration of the holes 32 allows a nail to be placed through the holes at an angle. This angular orientation of the nails not only provides a stronger and more secure connection between the steel placement member and the form, but also accommodates the practical difficulty of driving a nail straight through the hole during assembly in the field. When the steel placement member is secured to the wood form, the back surface 34 of the plate member abuts the interior surface of the wood form.

The entire steel placement member is integrally molded of styrene and/or polyethylene by conventional high-speed injection molding techniques suitable for mass-production at relatively low cost. The steel placement member holds a reinforcing steel bar three inches, or any required distance, above the foundation pad, this distance corresponding to the distance from the channel 18 to the tip 31 of the arrow member 30. The steel placement member may thus be easily positioned within the foundation form merely by abutting the back surface of the plate member against the interior surface of the wood form and by resting the tip of the arrow member against the foundation pad, thereby achieving unparalleled accuracy in placement.

Circular channel 18 is formed in the tubular body 16 from the open end 36 of the channel to depth a terminating two inches inside the back surface 34 of the plate member 20, the portion between the point of termination of the channel and the back surface of the plate member being solid. Hence, the steel placement member, when an end of a reinforcing steel bar is received within the channel, holds the end of the reinforcing bar two inches inside the surface or face of the concrete when the concrete is cast within a form. In cases where a form is not utilized, the circular channel 18 is formed in the tubular body so as to terminate at a depth three inches inside the face of the concrete. The channel may be formed to any desired depth so as to conform with technical specifications for placement of the reinforcing steel.

The inside diameter d of the circular channel 18 is formed so as to accommodate diverse sizes of reinforcing steel bars, from #5 to #11 size reinforcing steel bars. The steel placement members are adapted to be color-coded according to the size of reinforcing bar which may be accommodated, thereby allowing for quick and easy identification and selection in the field. In cases of exposed concrete design, all of the sizes can be provided in concrete gray.

The steel placement members support the steel firmly and are of sufficient strength to allow workers to walk out on the reinforcement mats as required to set dowels or bolts or for other procedures. The steel placement members are also capable of withstanding the pressure and stres imposed thereon during placement of the concrete without failure or deformation.

Subsequent to placement and curing of the concrete, when the wood forms are removed, the back surface 34 of plate member 20 remains visible along the face of the concrete. It is thus possible to easily inspect for proper steel placement utilization during construction, and even years later. The color-coding system enables builders, architects and engineers to verify proper size selection of steel reinforcing bars in concrete structural members.

Formed as an integral molding of styrene and polyethylene, the steel placement members are highly strong and durable, yet are light in weight, easy to transport and manipulate during use, and are conducive to bulk storage.

Figure 4:
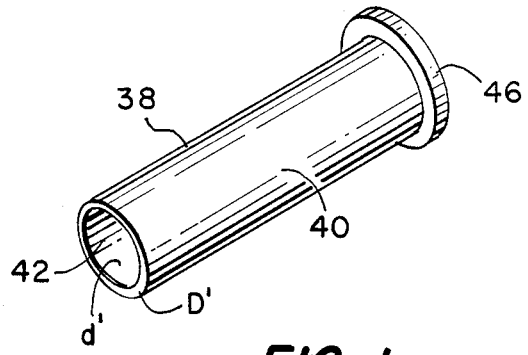
FIG. 4 is a perspective view of a first alternative embodiment for the steel placement member of the present invention.

FIG. 4 depicts a first alternative embodiment for the steel placement member of the present invention. The embodiment shown in FIG. 4 is particularly adapted for utilization with reinforcing steel bars of size #12 and larger. The steel placement member 38 illustrated in FIG. 4 comprises a tubular body 40 having a circular channel 42 formed in one end for receiving the end of a reinforcing steel bar, the channel being defined in the tubular body by inside diameter d' and outside diameter D'. The end of the tubular body opposite the channel 42 is provided with a generally circular plate member 44 lying in a plane perpendicular to the longitudinal axis of the tubular body and having a diameter greater than outside diameter D'. The plate member is provided with a planar back surface 46 which is adapted to abut the interior surface of a wood form as was discussed in connection with the embodiment of FIGS. 1–3. The plate member 44 of steel placement member 38 is positively and securely maintained in abutting relationship to the wood form, without the need for any securing means, by virtue of a reinforcing steel bar extending tightly between a pair of steel placement members which abut, respectively, the wood form.

It is to be understood that various modifications and changes may be made with respect to the foregoing detailed description without departing from the spirit and scope of the present invention. Thus, the appended claims should be liberally construed, and should not be restricted to their literal terms.

What is claimed is:

1. A steel placement member adapted to support and position a reinforcing steel bar in a concrete structural member formed by placing concrete within an area defined by a bottom horizontal surface and a vertical perimetrical surface comprising a tubular body having a first end, a second end, and a longitudinal axis, a generally circular channel formed in said first end of said body, said channel being defined in said tubular body by an inside diameter and an outside diameter, a generally planar plate member provided on said second end of said body, said plate member being located in a plane perpendicular to said longitudinal axis and having a back surface, said back surface being adapted to abut said vertical perimetrical surface, said plate member being defined by first, second, third and fourth corners, said first corner being disposed directly above said tubular body, said second and third corners being disposed directly one on each side of said tubular body, said fourth corner being disposed directly below said tubular body, said fourth corner being provided with an integral vertically depending arrow member, said arrow member having a tip adapted to rest against said horizontal bottom surface, said arrow member having a length, as measured by the distance from said channel to said tip, for holding said reinforcing bar a desired distance above said bottom surface when said back surface of said plate member abuts said vertical surface, said channel being adapted to receive an end of said reinforcing steel bar, said channel having a depth so as to support said end of said reinforcing steel bar a desired distance inside said vertical surface.

2. A steel placement member adapted to support and position a reinforcing steel bar in a concrete structural member formed by placing concrete within an area defined by a bottom horizontal surface and a vertical perimetrical surface comprising an integral tubular body defined by a first end, a second end, a generally planar plate member provided on said second end perpendicular to said tubular body, said plate member having a back surface, said tubular body being further defined by a continuous outer diameter surface, a continuous inner diameter surface extending from said first end toward said second end but being interrupted by a partition located within said tubular body between said first and said second ends of said tubular body, said inner diameter surface and said partition together defining an enclosed circular channel having an open end coincident with said first end and a closed end coincident with said partition, said back surface of said plate member being adapted to abut said vertical perimetrical surface, said channel being adapted to receive an end of said reinforcing bar through said open end of said channel, said reinforcing bar being adapted to be disposed in said channel such that said end of said bar abuts said partition, said closed end of said channel being located with respect to said back surface of said plate member such that said end of said bar abutting said partition is positively held within said channel a specified distance inside said vertical surface, said back surface of said plate member being adapted to be located at a specified vertical height above said horizontal bottom surface.

3. The steel placement member recited in claim 2 wherein said channel is adapted to be formed of diverse inside diameters, said inside diameters corresponding to a size of reinforcing steel bar.

4. The steel placement member recited in claim 3 wherein said steel placement member is adapted to be color-coded according to said inside diameter of said channel.

5. The steel placement member recited in claim 2 wherein said steel placement member is formed as an integral molding from styrene.

6. The steel placement member recited in claim 2 wherein said steel placement member is formed as an integral molding from polyethylene.

7. The steel placement member recited in claim 2 wherein said plate member is defined by first, second, third and fourth corners, said first corner being disposed directly above said tubular body, said second and third corners being disposed directly one on each side of said tubular body, said fourth corner being disposed directly below said tubular body.

8. The steel placement member recited in claim 7 wherein said first, second and third corners are each provided with an outwardly tapering through hole, each of said through holes being adapted to receive means for securing said steel placement member to said vertical perimetrical surface.

9. The steel placement member recited in claim 7 wherein said fourth corner is provided with an integral vertically depending arrow member, said arrow member having a tip adapted to rest against said horizontal bottom surface, said arrow member having a length, as measured by the distance from said channel to said tip, for holding said reinforcing bar a desired distance above said bottom surface when said back surface of said plate member abuts said vertical surface.

10. The steel placement member recited in claim 2 wherein said plate member is generally circular, being larger in diameter than said outside diameter of said tubular body.

11. The steel placement member recited in claim 2 wherein said specified distance inside said vertical surface is at least two inches.

12. A steel placement member adapted to support and position a reinforcing steel bar in a concrete structural member formed by placing concrete within an area defined by a horizontal bottom surface and a vertical perimetrical surface comprising a tubular body having a first end, a second end, and a longitudinal axis, a generally circular channel formed in said first end of said body, said channel being defined in said tubular body by an inside diameter and an outside diameter, a generally planar plate member provided on said second end of said body, said plate member being located in a plane perpendicular to said longitudinal axis and having a back surface, said plate member being defined by first, second, third and fourth corners, said first corner being disposed directly above said tubular body, said second and third corners being disposed directly one on each side of said tubular body, said fourth corner being disposed directly below said tubular body and being provided with an integral vertically depending arrow member having a tip, said back surface of said plate member being adapted to abut said vertical perimetrical surface, said tip being adapted to rest against said horizontal bottom surface, said channel being adapted to receive an end of said reinforcing bar, said channel having a depth so as to support said end of said reinforcing bar a desired distance inside said vertical surface, said arrow member having a length, as measured by the distance from said channel to said tip, for holding said reinforcing bar a desired distance above said bottom surface when said back surface of said plate member abuts said vertical surface.

13. The steel placement member recited in claim 12 wherein said first, second and third corners are each provided with an outwardly tapering through hole, each of said through holes being adapted to receive means for securing said steel placement member to said vertical perimetrical surface.

14. The steel placement member recited in claim 12 wherein said plate member is generally square.

15. The steel placement member recited in claim 12 wherein said channel is adapted to be formed of diverse inside diameters, said inside diameters corresponding to a size of reinforcing steel bar.

16. The steel placement member recited in claim 15 wherein said steel placement member is adapted to be color-coded according to said inside diameter of said channel.

17. The steel placement member recited in claim 12 wherein said steel placement member is formed as an integral molding.

* * * * *